United States Patent [19]

Bassani

[11] 4,291,441

[45] Sep. 29, 1981

[54] APPARATUS FOR OPENING TEXTILE FABRICS IN ROPE FORM

[76] Inventor: Mariano Bassani, Via Trento Trieste 7, Arcore (Milan), Italy

[21] Appl. No.: 146,916

[22] Filed: May 2, 1980

[30] Foreign Application Priority Data

May 4, 1979 [IT] Italy ..... 67933 A/79

[51] Int. Cl.[3] ..... D06C 3/06

[52] U.S. Cl. ..... 26/75; 26/105; 226/20

[58] Field of Search ..... 26/51.3, 51.4, 51.5, 26/75, 99, 105; 226/18, 19, 20

[56] References Cited

U.S. PATENT DOCUMENTS

| | | | |
|---|---|---|---|
| 1,387,155 | 8/1921 | Huber | 26/51.3 |
| 3,740,805 | 6/1973 | Catallo | 26/51.3 X |
| 3,765,616 | 10/1973 | Hutzenlaub et al. | 26/99 X |
| 4,224,724 | 9/1980 | Bassani et al. | 26/75 |

FOREIGN PATENT DOCUMENTS

| | | | |
|---|---|---|---|
| 761830 | 11/1956 | United Kingdom | 26/51.3 |

*Primary Examiner*—Robert Mackey
*Attorney, Agent, or Firm*—Sughrue, Mion, Zinn, Macpeak and Seas

[57] ABSTRACT

Apparatus for opening a textile gathered in rope form includes a spreading device and a centering device, downstream of the spreading device, including two cylinders, maintained with their axes parallel but pivotable in a common plane parallel to the general, desired direction of advance of the textile, between two extreme positions inclined on opposite sides of the said direction. The pivoting of the cylinders is controlled through a sensor which senses a displacement of the textile from the desired direction and acts to return the textile to this direction. If the recall action of the cylinders in either extreme position is insufficient, a respective control device is activated which pivots a spreading cylinder of the spreading device out of its normal working position, in which it is parallel to the other spreading cylinder, into one of two extreme positions to exert a further recall action on the textile.

6 Claims, 4 Drawing Figures

APPARATUS FOR OPENING TEXTILE FABRICS IN ROPE FORM

The present invention relates to apparatus for opening a textile which is gathered together in the form of a rope.

In particular the invention relates to apparatus for opening a gathered textile, of the type including a spreading device comprising two spreading cylinder with helically-ridged surfaces located in the path of advancement of the textile through the apparatus such that the textile passes circumferentially over a portion of each surface in succession, drive means for rotating each cylinder about its longitudinal axis in the opposite circumferential direction to the direction of advance of the textile over the respective surfaces, the two cylinders being rotated in opposite senses, in use, and means for displacing one of the cylinders perpendicular to its axis to vary the frictional force between the textile and the cylinders, in use.

Apparatus for opening gathered textiles of the type mentioned above is described in Italian patent application No. 68,386-A/77 of the 15th June 1977, of which the applicant is cotitular. In use of this apparatus, it has been found that, when the textile is displaced from its desired direction of advance, the means used until now for recalling it to its preferred position are sometimes insufficient.

The object of the present invention is to improve apparatus of the above type to overcome this problem. Thus the present invention provides apparatus of the type specified above in which one of the cylinders is pivotable in opposite senses from a normal working position, in which the axes of the cylinders are parallel to each other, into two respective extreme positions in which its axis is inclined to the axis of the other cylinder;

means are provided for pivoting the said one cylinder between the normal working position and the two extreme positions; a sensor is located downstream of the spreading device for sensing a change in direction of advance of the textile, the sensor being operative to activate the said pivoting means to pivot the said one cylinder from its normal position so as to reduce the contact pressure between the textile and the ends of the cylinders to which the textile is displaced.

The greater frictional force between the textile and the opposite ends of the cylinders thus exerts a recall force, returning the textile to its desired, central position of advance.

The cylinders of the apparatus described above are normally located one above the other with their axes in a common vertical plane, the textile being fed downwardly between them. The cylinder which is displaceable in a direction perpendicular to its axis to vary the overal friction between the textile and the cylinders is preferably displaceable out of the said common vertical plane. In the improved apparatus of the present invention, the cylinder which is pivotable into a position in which its axis is inclined to the axis of the other cylinder is preferably also pivotable out of the said common plane.

The means for pivoting the said one cylinder into its two extreme positions preferably comprise hydraulic actuators arranged to act on the cylinder in opposite respective directions.

One embodiment of the invention will now be more particularly described by way of example with reference to the accompanying drawings, in which.

Figure 1:
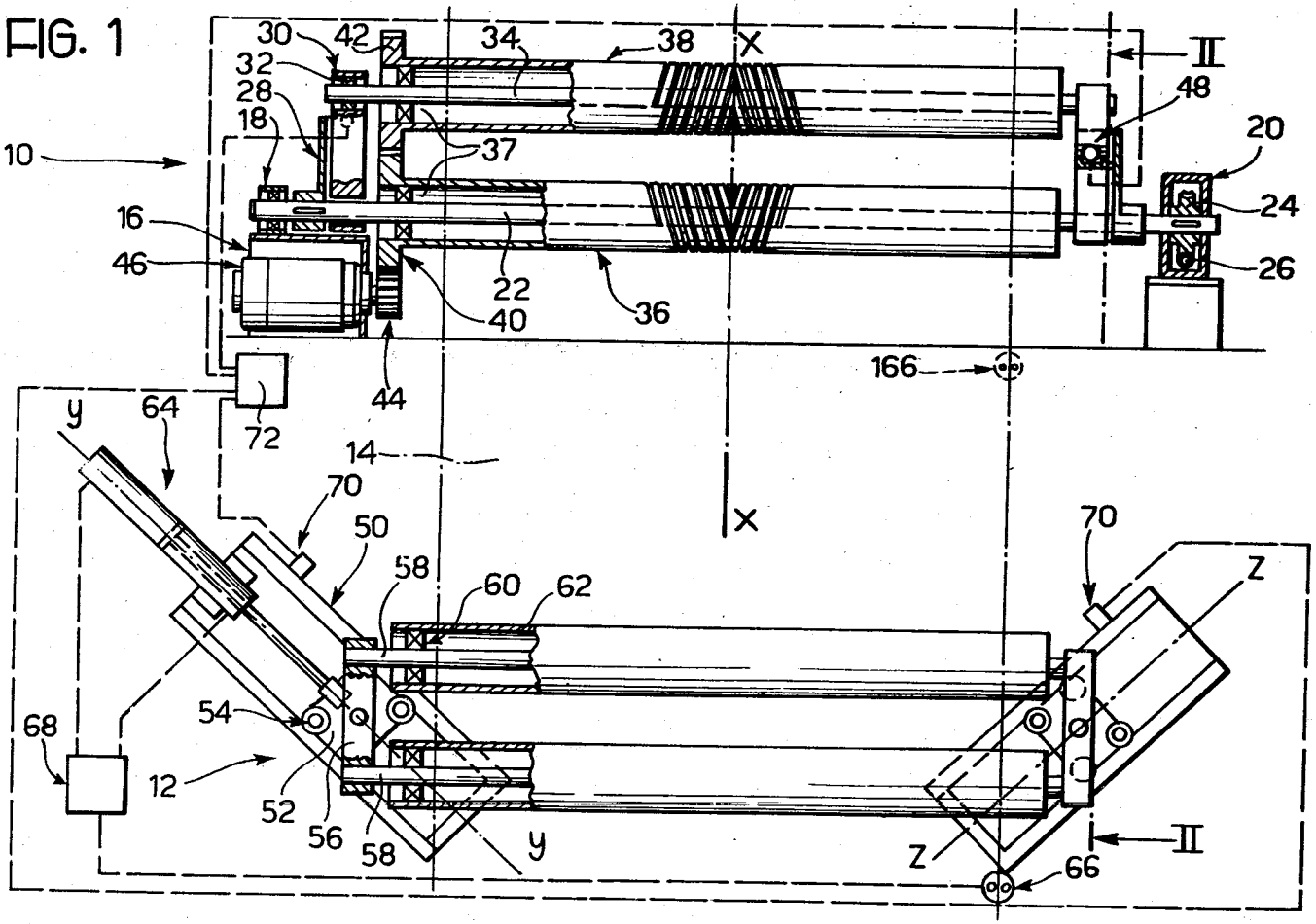
FIG. 1 is a partially-sectioned elevational view of apparatus according to invention for opening textiles in rope form.

Referring to the drawings, a spreading device and a centering device for a textile 14 are shown generally indicated 10 and 12 respectively, the spreading device 10 being located directly above the centering device 12. The textile 14 which comes from a finishing process, such as dyeing, bleaching or washing and is gathered together in the form of a rope, is drawn downwardly through the spreading and centering devices 10,12 by a drawing device (not shown) located downstream of the centering device 12; the desired median axis of advance of the textile 14 through the spreading and centering devices is shown as X—X.

The spreading device 10 includes a fixed support structure 16 and a horizontally extending shaft 22 which is mounted for rotation about its longitudinal axis in two end supports 18,20 of the support structure. Pivotally mounted on the shaft 22, adjacent each end, are two upwardly projecting support arms 30 which are located between the supports 18,20 and support between them, at their upper ends, a second shaft 34.

In its normal position, shown in FIG. 1 the shaft 34 extends parallel to the shaft 22 and is supported in the arms 30 by means of roller bearings 32 for rotation about its longitudinal axis.

Each shaft 22,34 is coaxially surrounded by a cylinder 36,38 respectively having an outer surface formed with multiple helical ridges for spreading the textile 14 to its full width, each cylinder 36,38 being supported by its respective shaft for rotation relative thereto by means of roller bearings 37. The two cylinders 36,38 are each provided at one end with a respective ring gear 40,42, the ring gears 40,42 being meshed with each other and the ring gear 40 being meshed with a further gear wheel 44 which is rotatable by a motor 46 carried by the support structure 16.

Between each support arm 30 and the adjacent end support 18 or 20, the shaft 22 carries a plate or panel 28, disposed in a plane perpendicular to the axis of the shaft 22. Each panel 28 supports a jack 48, the cylinder of which is pivotally mounted on the panel 28 while the shaft thereof is pivotally connected to the adjacent support arm 30, intermediate the shafts 22 and 34. Each jack 48 is operable independently to pivot the respective arm 30 and the shaft 34 carried thereby about the shaft 22 between a first position, shown in FIG. 2, in which the arm 30 is pressed against a projecting abutment flange **28*a* of the adjacent panel 28, and a second position, shown in FIG. 3, in which the arm 30 is spaced from the said flange 28*a*. Each jack 48 is thus operable to pivot the shaft 34 about the opposite end to incline it to the shaft 22**.

Figure 4:
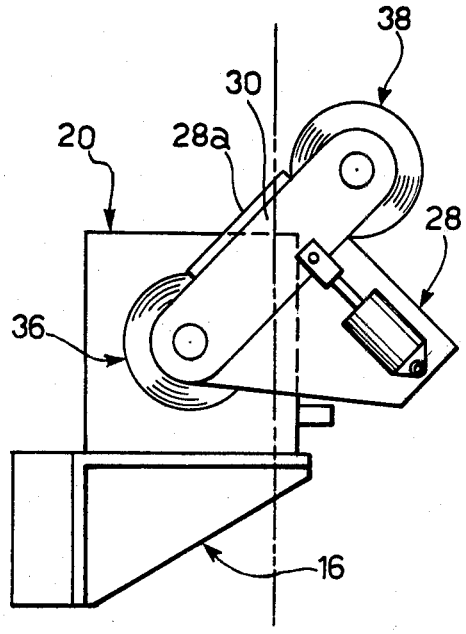

The right hand end of the shaft 22, as seen in FIG. 1, which is supported by the support 20, carries a helical gear 24 meshed with a worm screw 26 which is rotatable about its axis by means of a control wheel (not shown). Rotation of the control wheel, through the meshing of the worm gear 26 and gear wheel 24, effects pivoting of the shaft 22, and hence the plates 28 fixed to the shaft 22, about the axis of the shaft 22. The arrangement of the jacks 48 and abutment flanges 28*a* forces both arms 30 carrying the shaft 34 to pivot with the plates 28, the shaft 22 being pivotable between a first position, shown in FIG. 2, in which the shaft 34 is supported in its normal position, vertically above the shaft 22, and a second position, shown in FIG. 4, in which the shaft 34 is still parallel to the shaft 22, but the plane containing the axes of the shafts 22, 34 is inclined to the vertical and the textile 14 can pass between the cylinders 36,38 without touching their surfaces.

The centering device 12 located below the spreading device 10 includes two tubular centering rollers 62, each rotatably mounted by means of roller bearings 60 on a respective coaxial shaft 58, the shafts 58 being supported by common end support members 56 such that their axes are parallel and lie in a common vertical plane which also contains the axis of the shaft 22 of the spreading device 10.

The support members 56 are in turn pivotally mounted, substantially at their centers, about respective pivot axes perpendicular to the vertical plane containg the axes of the shafts 58, each on a respective slide 52 which is captive in a respective fixed guide channel 50. Each slide 52 has two rollers 54 each engaged with a respective one of a pair of opposite inwardly-projecting longitudinal edges of the respective guide channel 50 to guide longitudinal sliding movement of the slide 52 in the respective guide channel 50. The two guide channels 50 diverge upwardly and symmetrically with respect to the median axis X—X of advance of the textile 14 such that the axes of sliding movement, shown as Y—Y and Z—Z respectively, of the two slides 52 lie in a common vertical plane but are equally and oppositely inclined to the axis X—X.

The left-hand guide channel 50, as seen in FIG. 1, supports a jack generally indicated 64, the cylinder of which is mounted at the upper end of the channel 50 while the piston shaft thereof is fixed to the slide 52 housed in that channel. The jack 64 is operable to drive sliding movement of the slide 52, to which it is attached, in its channel 50 along the axis Y—Y, this movement causing sliding movement of the other slide 52 in its channel 50 along the axis Z—Z; downward movement of the left-hand slide causes corresponding upward movement of the right-hand side, and vice versa, to incline the axes of the centering rollers 62 to the horizontal.

The maximum inclination of the rollers 62 to the horizontal, and to the axis of advance X—X of the textile 14, on either side of this axis, is determined by the end-of-stroke positions of the jack 64, and hence of the slides 52. A device 70 is located at the upper end-of-stroke position of each slide 52 and is activated thereby when the respective slide reaches this position, the respective device 70 sending a control signal to activate a respective jack 48 through an electrical control circuit including a control device 72.

The jack 64 is controlled by a further control circuit including photoelectric sensor 66 located downstream of the centering device 12, and arranged to detect the position of the selvedge of the textile 14. The sensor 66 is connected to a control device 68 which amplifies the signal from the sensor 66.

The operation of the apparatus described above is as follows.

Figure 2:
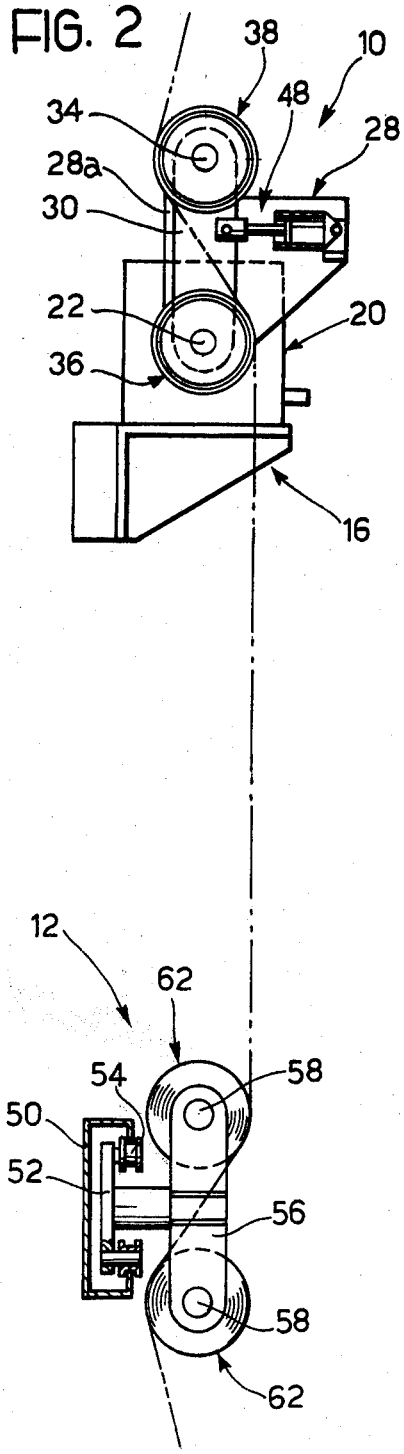
FIG. 2 is a section taken on line II—II of FIG. 1.
Figure 3:
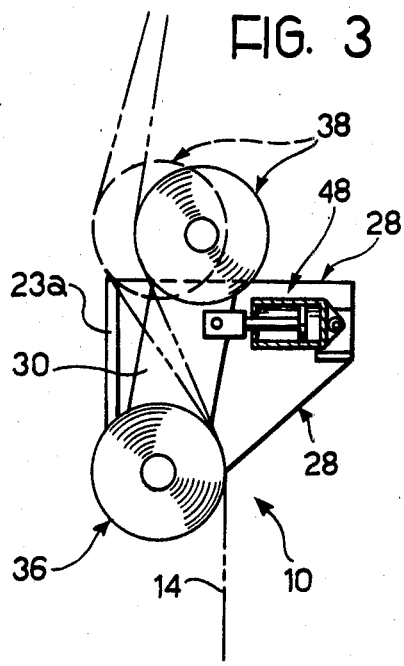
FIGS. 3 and 4 illustrate details of FIG. 2 in different respective working positions.

The cylinders 36, 38 of the spreading device 10 are rotated about their axes by the motor 46 through the gear transmission system 44,40,42 and the textile 14 is drawn over and between the cylinders 36,38 as shown in FIG. 2, such that it passes over their surfaces in the opposite sense to their circumferential direction of motion. The friction between the textile 14 and the surfaces of the cylinders 36,38, and particularly the helically-ridged nature of these surfaces, spreads the textile from its gathered form to its full width. If it is desired to reduce the friction between the spreading cylinders 36 and 38 and the textile 14 to correct the spreading action, the control wheel which activates the worm gear 26, and hence the gear wheel 24, is rotated to rotate the shaft 22 and pivot the upper cylinder 38 towards the position shown in FIG. 4. Thus a position of the cylinder 38 intermediate the two extreme positions (illustrated in FIGS. 2 and 4), may be chosen according to the friction required between the spreading cylinders 36 and 38 and the textile 14 to spread the textile 14 most conveniently to its full width.

Should the sensor 66 detect a lateral displacement of the selvedge of the textile 14 during its passage over the rollers 62, a signal is sent to the control device 68 which actuates the jack 64 to displace the slides 52 and centering rollers 62. Thus, for example, if the textile 14 has been displaced towards the right, the left-hand slide 52 is drawn upwardly, to the left, to incline the centering rollers 62 with respect to the axis X—X so as to exert a recall force on the textile 14 towards the left, that is, towards the central optimum position of advancement. Similarly, if the textile 14 is displaced towards the left, the slide 52 fixed to the shaft of the jack 64 is displaced downwardly, to the right, to incline rollers 62 in the opposite sense to that described above to exert a recall action in the opposite direction.

The maximum recall action of the centering rollers 62 is achieved when they have their maximum possible inclination to the axis X—X, that is, when one or the other of the slides 52 is in its upper end-of-stroke position; at this point a respective end-of-stroke device 70 is activated and sends a signal to the control device 72. This device activates the jack 48 of the spreading device 10 which is situated on the opposite side of the axis X—X from the end-of-stroke device 70 which has activated it. For example, in the first case indicated above, when the textile 14 has been displaced towards the right, the left-hand slide 52 activates its end-of-stroke device 70 which in turn activates the jack 48 to the right of the spreading cylinders 36,38. The withdrawal of the shaft of this jack pivots the respective support arm 30 relative to the plate 28, to the position shown in FIG. 3 in which the shaft 34 is inclined to the shaft 22. Thus the contact pressure between the textile 14 and the right hand end portions of the spreading cylinders 36 and 38 towards which the textile has been displaced is reduced. The textile is thus recalled towards the central position of advancement by the entrainment action exerted by the cylinders 36,38 on the left hand side of the textile 14.

Similarly, when the textile 14 is displaced to the left to such an extent that the angular displacement of the centering cylinders cannot recall it to its central position, the right-hand end-of-stroke device 70 is activated and actuates the left-hand jack 48 to incline the cylinder 34 in the opposite sense from that described above to exert the necessary recall force on the textile.

In the embodiment described above a photo-electric sensor has been illustrated but any other suitable sensor, for example, a pneumatic or mechanical sensor may be employed. Similarly, the end-of-stroke devices 70 may, for example be electrical switches connected in the electrical circuit of the control device 72 or pneumatic switches inserted in the circuit for activating the jacks 48.

The apparatus described above includes both a spreading device 10, and a centering device 12, but the invention may be applied to apparatus comprising solely the spreading device 10 by locating the sensor 66 immediately downstream of the spreading cylinders 36 and 38, as illustrated in broken outline as 166 in FIG. 1. The sensor 166 is connected to activate the jacks 48 through a control device (not illustrated). When the textile 14 tends to be displaced laterally, the signal conveyed by the sensor 166 to the control device activates one of the jacks 48 so as to incline the shaft 34 to reduce the contact pressure between the textile and the ends of the spreading cylinders 36,38 towards which the textile tends to accumulate. The greater pressure at the opposite ends of the cylinders thus recalls the textile to its central position.

I claim:

1. Apparatus for opening a textile which is gathered together in rope form, including a spreading device comprising:

two spreading cylinders with helically-ridged surfaces located in the path of advancement of said textile through said apparatus such that the textile passes circumferentially over a portion of each said surface in succession; drive means for rotating each said cylinder about its longitudinal axis in the opposite circumferential direction to the direction of advance of said textile over the respective said surface, said two cylinders being rotated in opposite senses, in use; and displacing means for displacing a displaceable one of said cylinders in a direction perpendicular to its axis to vary the frictional force between said textile and the surfaces of the cylinders, in use, wherein:

a pivotable one of said two spreading cylinders is pivotable, in opposite senses, from a normal working position, in which said longitudinal axes of said cylinders are parallel to each other, into two respective extreme positions in which the axis of said pivotable cylinder is inclined to the axis of the other of said cylinders;

pivoting means are provided for pivoting said pivotable cylinder between said normal working position and each of said two extreme positions; and sensor means are located downstream of said spreading device for sensing a displacement of said textile from said direction of advance, said sensor means being operative on sensing a displacement of the textile to activate said pivoting means to pivot said pivotable cylinder from said normal working position to one of said extreme positions so as to reduce the frictional force between the textile and the ends of the cylinders towards which the textile is displaced.

2. Apparatus as in claim 1, wherein said one cylinder is pivotable in a plane perpendicular to a plane containing the axes of said two cylinders in the normal working position of said one cylinder.

3. Apparatus as in claim 2, wherein said drive means for rotating the spreading cylinders about their axes comprise;

two gear wheels, one carried coaxially by each cylinder, said gear wheels being meshed with each other;

a motor carried by said support structure; and a third gear wheel connected to said motor and meshed with one of said two gear wheels to transmit rotational drive thereto from said motor.

4. Apparatus as in claim 2, wherein said spreading device includes:

a support structure;

the non-pivotable cylinder is mounted coaxially on a first shaft for rotation relative thereto, said first shaft being mounted for rotation about its longitudinal axis in said support structure;

two spaced-apart support arms extend radially from said first shaft and are mounted for rotation relative thereto;

said pivotable cylinder is mounted coaxially on a second shaft for rotation relative thereto, said second shaft being carried by said support arms;

two panels are fixed to said first shaft for rotation therewith, one adjacent each said support arm, each said panel having a projecting stop, and wherein said pivoting means for pivoting said pivotable cylinder in opposite senses comprise respective, independent hydraulic actuators each connected between a respective said support arm and the adjacent said panel and operative to pivot the support arm relative to said first shaft between said normal working position, in which the respective support arm abuts said projecting stop of the adjacent panel, and a respective said extreme position of the pivotable cylinder.

5. Apparatus as in claim 4, wherein said displaceable cylinder comprises said pivotable cylinder and said displacing means for displacing the displaceable cylinder include a gear wheel carried by said first shaft;

a worm gear carried by said support structure and meshed with said gear wheel; and said worm gear being rotatable to transmit rotational drive through said gear wheel to rotate said first shaft about its longitudinal axis.

6. Apparatus as in claim 1, further including a centering device located downstream of said spreading device in the direction of advance of said textile, said centering device including:

a support structure;

two slides mounted on said support structure one on either side of the path of advancement of the textile, for sliding movement along respective axes which are equally inclined to and converge in the direction of advance of the textile, said axes lying in a plane substantially parallel to said direction of advance of the textile;

two end supports, one mounted on each said slide for rotation about a respective axis perpendicular to said plane containing said axes of sliding movement;

at least two radially spaced apart centering rollers supported between said end supports with their longitudinal axes parallel to each other and in a common plane parallel to said plane containing said axes of sliding movement;

a sensor located downstream of said centering device in said direction of advance of said textile and operative to sense a displacement of the textile from said direction;

actuating means connected to one of said slides to drive said sliding movement between two end-of-stroke positions;

control means connected to said sensor and operative, on sensing a displacement of the textile by said sensor, to control said actuating means to drive said slide towards one of said end-of-stroke positions so as to incline the axes of said centering rollers to tend to recall the textile to said direction of advance; and wherein said sensor means include end-of-stroke devices located one adjacent each said slide, each said device being actuated on movement of the slide driven by said actuating means into a respective one of said two end-of-stroke positions.

* * * * *